US007390475B2

(12) United States Patent
Kambara et al.

(10) Patent No.: US 7,390,475 B2
(45) Date of Patent: Jun. 24, 2008

(54) PROCESS FOR PRODUCING VAPOR-GROWN CARBON FIBERS

(75) Inventors: Eiji Kambara, Kawasaki (JP); Tomoyoshi Higashi, Kawasaki (JP); Katsuyuki Tsuji, Kawasaki (JP)

(73) Assignee: Showa Denko K.K., Tokyo (JP)

( * ) Notice: Subject to any disclaimer, the term of this patent is extended or adjusted under 35 U.S.C. 154(b) by 457 days.

(21) Appl. No.: 10/504,875

(22) PCT Filed: May 22, 2003

(86) PCT No.: PCT/JP03/06418

§ 371 (c)(1),
(2), (4) Date: Aug. 17, 2004

(87) PCT Pub. No.: WO03/097909

PCT Pub. Date: Nov. 27, 2003

(65) Prior Publication Data

US 2005/0104044 A1 May 19, 2005

Related U.S. Application Data

(60) Provisional application No. 60/383,623, filed on May 29, 2002.

(30) Foreign Application Priority Data

May 22, 2002 (JP) ..... 2002-147953

(51) Int. Cl.
*D01F 9/12* (2006.01)

(52) U.S. Cl. ..... 423/447.1; 423/445 R; 423/447.3; 423/453; 423/415.1; 977/890; 977/893; 252/502

(58) Field of Classification Search ..... 252/500, 252/502; 423/447.1, 445 R, 447.3, 453, 423/415.1; 977/890, 893
See application file for complete search history.

(56) References Cited

U.S. PATENT DOCUMENTS 4,572,813 A * 2/1986 Arakawa ..... 264/29.2

(Continued)

FOREIGN PATENT DOCUMENTS

EP 0 214 302 A1 3/1987

(Continued)

OTHER PUBLICATIONS

Tibbetts. Vapor grown Carbon Fibers. Carbon Fibers Filaments and composites, Figueiredo et a. (eds.), 1990, Netherlands, pp. 73-94.*

(Continued)

*Primary Examiner*—Mark Kopec
*Assistant Examiner*—Tri V Nguyen
(74) *Attorney, Agent, or Firm*—Sughrue Mion, PLLC

(57) ABSTRACT

A process for continuously producing carbon fibers in a vapor phase by causing a carbon compound to contact a catalyst and/or a catalyst precursor compound in a heating zone. In this process, the carbon compound, the catalyst precursor compound and an additional component are supplied to the heating zone, and these components are subjected to a reaction under a reaction condition such that at least a portion of the additional component is present as a solid or liquid in the heating zone.

21 Claims, 5 Drawing Sheets

U.S. PATENT DOCUMENTS

| | | | | |
|---|---|---|---|---|
| 4,663,230 | A * | 5/1987 | Tennent | 428/367 |
| 5,413,773 | A * | 5/1995 | Tibbetts et al. | 423/447.3 |
| 5,500,200 | A * | 3/1996 | Mandeville et al. | 423/447.3 |
| 6,878,360 | B1 * | 4/2005 | Ohsaki et al. | 423/447.3 |
| 2004/0136895 | A1 * | 7/2004 | Muramaki et al. | 423/447.3 |

FOREIGN PATENT DOCUMENTS

| | | | |
|---|---|---|---|
| JP | 02-006617 | A | 1/1990 |
| JP | 7-150419 | A | 6/1995 |
| JP | 11-107052 | A | 4/1999 |
| WO | WO 86/04937 | A1 | 8/1986 |
| WO | WO 90/07023 | A | 6/1990 |
| WO | WO 93/24687 | A | 12/1993 |
| WO | WO 95/31281 | A | 11/1995 |
| WO | WO 03/002789 | A | 1/2003 |

OTHER PUBLICATIONS

Hatana et al. Graphite Whiskers by New Processes and Their Composites. 30th National SAMPE Symposium, Mar. 21-29, 1985, pp. 1467-1476.*

Katsuki et al. Formation of carbon fibers from naphthalene on some sulfur-containing substrates. Carbon. vol. 19, 1981, p. 148-150.*

International Search Report, dated Dec. 29, 2003.

* cited by examiner

PROCESS FOR PRODUCING VAPOR-GROWN CARBON FIBERS

This Application claims the priority of an application based on U.S. Provisional Application Ser. No. 60/383,623 (filed on May 29, 2002).

TECHNICAL FIELD

The present invention relates to a process for effectively producing vapor-grown carbon fibers such as carbon nanotubes.

BACKGROUND ART

Various kinds of carbon fibers which are obtainable by vapor-phase growth (or vapor deposition) processes are inclusively referred to as vapor-grown carbon fibers. Vapor-grown carbon fibers has some advantages such that those having a high aspect ratio are easily obtainable, and therefore VGCF has actively and energetically been studied, and a large number of reports on these production processes have heretofore been published. Carbon nanotubes (i.e., a kind of carbon fibers having a fiber diameter on the order of nanometer(s)) which have particularly attracted much attention in recent years, may also be synthesized by appropriately applying the vapor phase-growth process to the production of the carbon nanotubes.

FIG. 1 is a schematic sectional view showing an example of the reactor for continuously producing carbon fibers by utilizing a vapor phase-growth process. In an example of the general production procedure using this apparatus, CO or hydrocarbon such as methane, acetylene, ethylene, benzene, and toluene is used as the raw material. When the raw material such as hydrocarbon assumes a gaseous state at normal (or ordinary) temperature, it is supplied to the apparatus in the gaseous state together with a carrier gas. When the raw material such as hydrocarbon assumes a liquid state at normal temperature, the raw material is vaporized and supplied to the apparatus in a mixture thereof with a carrier gas, or the raw material is sprayed in the liquid state toward the heating zone in the apparatus. As the carrier gas, it is possible to use nitrogen gas as an inert gas or hydrogen gas having a reducing property. As the catalyst, it is possible to use a supported catalyst comprising a carrier such as alumina, and a metal supported on the carrier, or an organometallic compound such as ferrocene. In a case where the supported catalyst is used, the supported catalyst is preliminarily placed in the reaction zone in the apparatus and is heated so as to effect a predetermined pre-treatment, and then the raw material such as hydrocarbon is supplied to the apparatus so as to cause a reaction (in the example shown in FIG. 1); or the pre-treated supported catalyst is supplied from the outside of the reaction system to the apparatus continuously or in a pulse-wise manner, to thereby cause a reaction. Alternatively, it is also possible to feed to the heating zone of the apparatus an organometallic compound such as ferrocene, as a homogeneous-type catalyst precursor compound, together with a raw material such as hydrocarbon continuously or in a pulse-wise manner, so that carbon fibers are formed by using as the catalyst the metal particles which have been produced due to the pyrolysis of the catalyst precursor compound. The resultant product is collected to the inside of the heating zone or the collector 4 (in FIG. 1) disposed at the terminal of the heating zone, and is recovered after the completion of the reaction for a predetermined time.

The processes for producing carbon fibers by utilizing a vapor-phase technique may be roughly classified into the following three kinds of processes, in view of the method of feeding a catalyst or a precursor compound for providing the catalyst.

(a) A method wherein a substrate or boat comprising alumina or graphite which carries thereon a catalyst or precursor compound therefor is placed in a heating zone, and a hydrocarbon gas to be supplied from a gas phase is caused to contact the substrate or boat;

(b) A method wherein particles of a catalyst or precursor compound therefor are dispersed in a liquid hydrocarbon, etc., and the particles are supplied from the outside of the reaction system into a heating zone continuously or in a pulse-wise manner, so that the particles are caused to contact the hydrocarbon at an elevated temperature; and (c) A method wherein metallocene or a carbonyl compound which is soluble in a liquid hydrocarbon is used as a catalyst precursor compound, and the hydrocarbon containing the precursor compound dissolved therein is supplied to a heating zone so that the catalyst is caused to contact the hydrocarbon at an elevated temperature.

Among these, an intended product can stably be obtained continuously, particularly by using the above method (c), and therefore, VGCF can be produced in an industrial scale by using this method (c). Further, with respect to the above method (b) which enables the continuous production of the carbon fibers, there have been reported a method wherein a suspension to which a surfactant has been added is used, for the purpose of stabilizing the ratio of the quantities of hydrocarbon and catalyst to be fed to the reaction system (JP-B (Examined Patent Publication) 6-65765; Patent Document 1); and a method wherein fine particles of a catalyst having uniform particle size of nano-order which have been synthesized by utilizing a microemulsion, are suspended in a hydrocarbon such as toluene, and the resultant suspension is continuously supplied to a heating zone, to thereby synthesize single walled carbon nanotubes (Kagaku Kogyo Nippo (The Chemical Daily) dated Oct. 15, 2001; Non-Patent Document 1).

[Patent Document 1]

JP-B 6-65765

[Non-Patent Document 1]

Kagaku Kogyo Nippo dated Oct. 15, 2001

However, the above method (a) includes steps wherein a catalyst or precursor compound therefor is applied to a substrate, the catalyst or precursor compound is, as desired, subjected to a pretreatment such as reduction thereof, then carbon fibers are produced by using the catalyst or precursor compound, and the resultant carbon fibers are taken out from the reaction system after the temperature is decreased. Further, these steps should be conduct independently. Accordingly, it is difficult to continuously obtain the intended product, and therefore the productivity thereof is poor. In addition, it is necessary to adopt a large number of steps such as preparation of the catalyst, application thereof to the substrate, the reduction of the catalyst as the pre-treatment into a metal state, the production of carbon fibers, and the recovery of carbon fibers from the substrate. Accordingly, this process is not economically advantageous.

On the other hand, in the above method (b) or (c), carbon fibers can be produced continuously, but these methods have a tendency that a sufficient amount of carbon fibers cannot be obtained unless the catalyst or precursor compound therefor are used in a large excess amount, as compared with the amount thereof which is required. Accordingly, not only an expensive catalyst or precursor compound therefor tends to be wasted in these methods, but also it is necessary to adopt a step of removing the by-products which are originated from the large-excess addition of the catalyst, etc., and such an additional step considerably impairs the economical advantage of these methods. As described above, a process which is capable of producing a large amount of vapor-grown carbon fibers inexpensively, has not been developed yet, and this inhibits the industrial-scale production of vapor-grown carbon fibers.

DISCLOSURE OF INVENTION

An object of the present invention is to provide a process which has solved the above-mentioned problems encountered in the prior art.

Another object of the present invention is to provide a process which is capable of inexpensively producing carbon fibers by utilizing simple steps, while attaining a high efficiency of a catalyst to be used therefor.

As a result of earnest study for solving the above-mentioned problem, the present inventors have found that, even when a small amount of a catalyst (i.e., an amount thereof which cannot give satisfactory results under the conventional conditions) is used, carbon fibers can be produced in a high yield by supplying to a heating zone a predetermined additive under the selection of a specific condition, in addition to a carbon compound and a catalyst precursor compound to be used as the raw materials for carbon fibers. The present invention has been accomplished on the basis of such a discovery.

The mechanism of the above present invention has not yet been clarified sufficiently. However, according to the investigation and knowledge of the present inventors, it is presumably considered that at least a portion of the additional component is present as a solid or liquid in the heating zone, and such a component is co-present with the catalyst or precursor compound therefor so as to suppress the aggregation (or agglomeration) or larger-size particle formation of the catalyst particles which have been generated in the heating zone, to thereby develop or maintain the catalytic activity which is required for growing the carbon fibers.

The process according to the present invention does not necessarily require a plurality of complicated steps such as the step of preparing the catalyst, and the step of separating the grown carbon fibers from the carrier of the catalyst, as compared with the conventional method wherein particulate (solid state) catalyst to be supported on a carrier such as alumina are preliminarily prepared, and the resultant particles are supplied to a heating zone. In the present invention, a specific additional component is added so as to obtain an effect (which is not less than that to be provided by the use of a supported catalyst) in a single step. Accordingly, the process according to the present invention is highly economically advantageous.

More specifically, for example, the present invention relates to the following embodiments [1] to [22].

[1] A process for continuously producing carbon fibers in a vapor phase by causing a carbon compound to contact a catalyst and/or a catalyst precursor compound in a heating zone;

wherein the carbon compound, the catalyst precursor compound and an additional component are supplied to the heating zone, and these components are subjected to a reaction under a reaction condition such that at least a portion of the additional component is present as a solid or liquid in the heating zone.

[2] A process for producing vapor-phase carbon fibers according to [1], wherein the reaction condition is at least one kind selected from: the temperature of the heating zone, the residence time, the concentration of the additional component to be supplied, and the method of supplying raw materials for the reaction.

[3] A process for producing vapor-phase carbon fibers according to [1] or [2], wherein the additional component is supplied to the heating zone in a liquid state, a solution state, or a mixture comprising the additional component dispersed in a liquid.

[4] A process for producing vapor-phase carbon fibers according to [1] or [2], wherein the catalyst precursor compound and the additional component are dissolved or dispersed in the same liquid which may also function as a carbon source, and the resultant solution or dispersion is supplied to the heating zone.

[5] A process for producing vapor-phase carbon fibers according to [1] or [2], wherein the catalyst precursor compound is supplied to the heating zone in a gaseous state; and the additional component is dissolved or dispersed in a liquid which may also function as a carbon source, and the resultant solution or dispersion is supplied to the heating zone.

[6] A process for producing vapor-phase carbon fibers according to [3], wherein a liquid component including the additional component is supplied by using a spraying nozzle provided in a reaction tube.

[7] A process for producing vapor-phase carbon fibers according to [6], wherein the temperature of the discharge portion of the spraying nozzle is 200° C. or lower.

[8] A process for producing vapor-phase carbon fibers according to [6], wherein the discharge rate of the liquid component including the additional component, and the discharge rate of a gas component are 30 m/s or below at the discharge portion of the nozzle.

[9] A process for producing vapor-phase carbon fibers according to [8], wherein the gas component comprises the carrier gas.

[10] A process for producing vapor-phase carbon fibers according to [1] or [2], wherein the additional component is an organic compound or organic polymer.

[11] A process for producing vapor-phase carbon fibers according to [1], wherein the additional component is at least one selected from the group consisting of the following additional components (1) to (3).

Additional component (1): inorganic compounds having a temperature of 180° C. or higher as the lower one selected from the boiling point and decomposition temperature thereof;

Additional component (2): organic compounds having a temperature of 180° C. or higher as the lower one selected from the boiling point and decomposition temperature thereof; and Additional component (3): organic polymers having a molecular weight of 200 or higher.

[12] A process for producing vapor-phase carbon fibers according to [11], wherein the additional component (1) is an inorganic compound containing at least one element selected from the group consisting of: Group II-XV elements in the 18-group type periodic table of elements.

[13] A process for producing vapor-phase carbon fibers according to [11], wherein the additional component (1) is an inorganic compound containing at least one element selected from the group consisting of: Mg, Ca, Sr, Ba, Y, La, Ti, Zr, Cr, Mo, W, Fe, Co, Ni, Cu, Zn, B, Al, C, Si, and Bi.

[14] A process for producing vapor-phase carbon fibers according to [11], wherein the additional component (1) is at least one selected from the group consisting of: powdery activated carbon, graphite, silica, alumina, magnesia, titania, zirconia, zeolite, calcium phosphate, aluminum phosphate, or carbon fibers having an aspect ratio of not smaller than 1 and not larger than 50, and an average fiber diameter of and not smaller than 10 nm and not larger than 300 nm.

[15] A process for producing vapor-phase carbon fibers according to [11], wherein the additional component (2) is an organic compound containing at least one element selected from the group consisting of: oxygen, nitrogen, sulfur and phosphorus.

[16] A process for producing vapor-phase carbon fibers according to [11], wherein the additional component (2) is at least one organic compound selected from the group consisting of: halogenated ethylenes, dienes, acetylene derivatives, styrene derivatives, vinyl ester derivatives, vinyl ether derivatives, vinyl ketone derivatives, acrylic acid derivatives, methacrylic acid derivatives, acrylic acid ester derivatives, methacrylic acid ester derivatives, acrylic amide derivatives, methacryl amide derivatives, acrylonitrile derivatives, methacrylonitrile derivatives, maleic acid derivatives, maleimide derivatives, vinyl amine derivatives, phenol derivatives, melamines, urea derivatives, amine derivatives, carboxylic acid derivatives, carboxylic acid ester derivatives, diol derivatives, polyol derivatives, isocyanate derivatives, and isothiocyanate derivatives.

[17] A process for producing vapor-phase carbon fibers according to [11], wherein the additional component (3) is an organic polymer containing at least one element selected from the group consisting of: oxygen, nitrogen, sulfur and phosphorus.

[18] A process for producing vapor-phase carbon fibers according to [11], wherein the additional component (3) is a polymer which has been obtained by the polymerization of at least one organic compound selected from the group consisting of: olefins, halogenated ethylenes, dienes, acetylene derivatives, styrene derivatives, vinyl ester derivatives, vinyl ether derivatives, vinyl ketone derivatives, acrylic acid derivatives, methacrylic acid derivatives, acrylic acid ester derivatives, methacrylic acid ester derivatives, acrylic amide derivatives, methacryl amide derivatives, acrylonitrile derivatives, methacrylonitrile derivatives, maleic acid derivatives, maleimide derivatives, vinyl amine derivatives, phenol derivatives, melamines/urea derivatives, amine derivatives, carboxylic acid derivatives, carboxylic acid ester derivatives, diol derivatives, polyol derivatives, isocyanate derivatives, and isothiocyanate derivatives.

[19] A process for producing vapor-phase carbon fibers according to [1], wherein the catalyst precursor compound is a compound which can be converted into a gas in the heating zone.

[20] A process for producing vapor-phase carbon fibers according to [1], wherein the catalyst precursor compound contains at least one element selected from the group consisting of: Group III, V, VI, VIII, IX and X elements in the 18-group type periodic table of elements.

[21] A process for producing vapor-phase carbon fibers according to [20], wherein the mass ratio of the additional component and a metal atoms contained in the catalyst precursor compound (additional component/metal atoms in catalyst precursor compound) is 0.001-10000.

[22] Vapor-grown carbon fibers which have been produced by a production process according to any one of claims 1-21.

Figure 1:
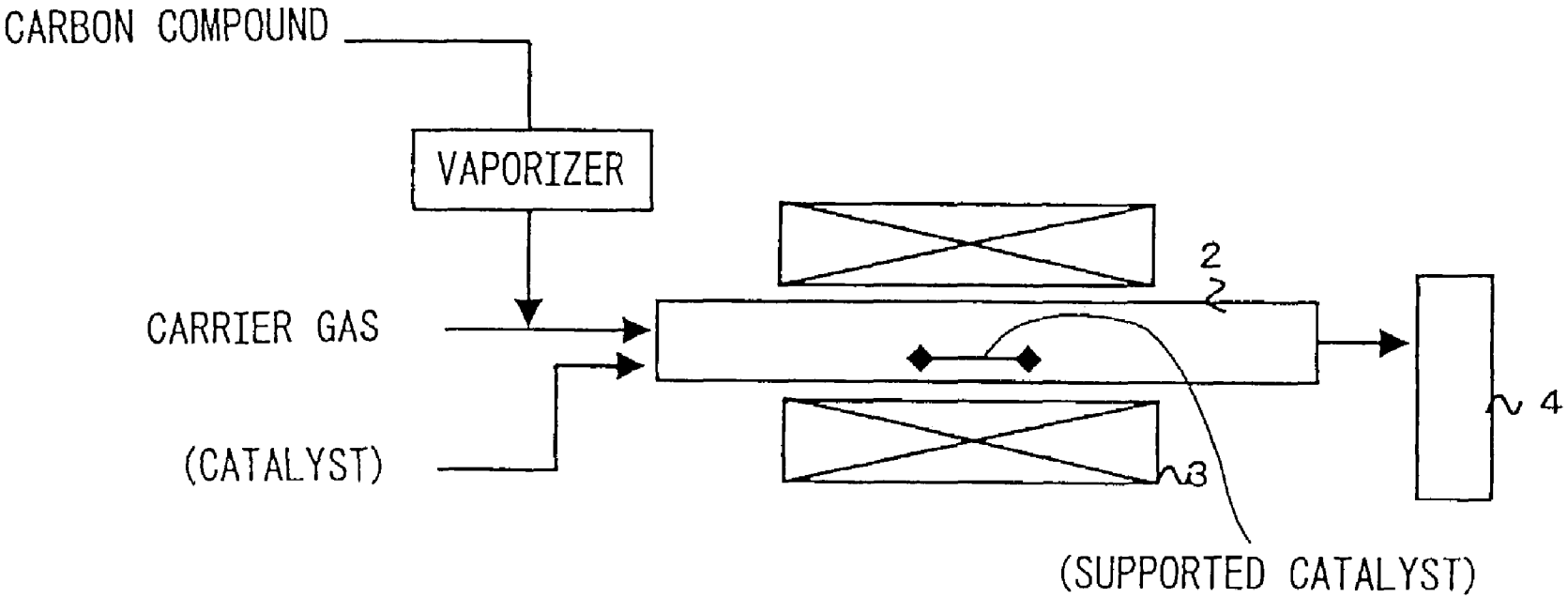
FIG. 1 is a schematic sectional view showing a representative example of the horizontal-type reactor for producing vapor-grown carbon fibers.

In these FIGS., the respective reference numerals have the following meanings:

1: raw material-spraying nozzle
2: reactor tube made of quartz
3: heater
4: collector
5: vaporizing heater
6: plate
7: vaporizer
8: carrier gas (inside)
9: reactant liquid
10: carrier gas (outside)
11: inner tube
12: outer tube
13: middle tube

BEST MODE FOR CARRYING OUT THE INVENTION

Hereinbelow, the present invention will be described in more detail with reference to the accompanying drawings as desired. In the following description, "%" and "part(s)" representing a quantitative proportion or ratio are those based on mass, unless otherwise noted specifically.

Carbon Compound

In the process for producing carbon fibers according to the present invention, the carbon compound as a raw material for carbon fibers are not particularly limited. As the carbon compound, it is possible to use $CCl_4$, $CHCl_3$, $CH_2Cl_2$, $CH_3Cl$, CO, $CO_2$, $CS_2$, or any of other organic compounds. Specific examples of particularly useful compound may include CO, $CO_2$, aliphatic hydrocarbons and aromatic hydrocarbons. Further, it is also possible to use a carbon compound containing another element such as nitrogen, phosphorus, oxygen, sulfur, fluorine, chlorine, bromine, and iodine, in addition to those element constituting the above-mentioned carbon compounds.

Preferred examples of the carbon compound may include: inorganic gases such as CO and $CO_2$; alkanes such as methane, ethane, propane, butane, pentane, hexane, heptane, and octane; alkenes such as ethylene, propylene and butadiene; alkynes such as acetylene; monocyclic aromatic hydrocarbons such as benzene, toluene, xylene and styrene; polycyclic compound having a condensed ring such as indene, naphthalene, anthracene and phenanthrene; cyclic paraffins such as cyclopropane, cyclopentane and cyclohexane; cyclic olefins such as cyclopentene, cyclohexene, cyclopentadiene and dicyclopentadiene; alicyclic hydrocarbon compounds having a condensed ring such as steroid. Further, it is also possible to use any of these hydrocarbons containing another element such as oxygen, nitrogen, sulfur, phosphorus and halogen, including: oxygen-containing compounds such as methanol, ethanol, propanol and butanol; sulfur-containing aliphatic compounds such as methyl thiol, methy lethyl sulfide and dimethyl thioketone; sulfur-containing aromatic compound such as phenyl thiol and diphenyl sulfide; sulfur-containing or nitrogen-containing heterocyclic compounds such as pyridine, quinoline, benzothiophene and thiophene; halogenated hydrocarbons such as chloroform, carbon tetrachloride, chloroethane and trichloroethylene. In addition, it is also possible to use any of various substances which is not a simple substance, such as natural gas, gasoline, kerosene, fuel oil, creosote oil, turpentine, camphor oil, pine oil, gear oil and cylinder oil. Of course, it is possible to use any mixture of these compounds and/or substances. More preferred examples of the carbon compound may include: CO, methane, ethane, propane, butane, ethylene, propylene, butadiene, acetylene, benzene, toluene, xylene and mixtures of these compounds.

Catalyst

The catalyst usable in the present invention is not particularly limited, as long as it is a material capable of promoting the growth of carbon fibers. Specific examples of the catalyst may include: at least one kind of metal selected from the Groups III to XII in the 18-Group type element periodic table based on the recommendation by the IUPAC in 1990. It is preferred to use at least one kind of metal selected from Groups III, V, VI, VIII, IX and X, and particularly at least one kind of metal selected from: iron, nickel, cobalt, ruthenium, rhodium, palladium, platinum and rare-earth elements.

Catalyst Precursor Compound

In the present invention, the "catalyst precursor compound" refers to a compound which is capable of providing at least one of the above-mentioned catalysts, when it is pyrolyzed (in some cases, and is further reduced) in a heating zone. For example, ferrocene which is a catalyst precursor compound is pyrolyzed in the heating zone to produce iron fine particles as a catalyst. Accordingly, it is preferred to use a catalyst precursor compound which is capable of providing a metal such as those as described above. Preferred examples of the catalyst precursor compound may include: metal compounds containing at least one kind of metal selected from the Groups III to XII in the periodic table. More preferred examples of the catalyst precursor compound may include: metal compounds containing at least one kind of metal selected from Groups III, V, VI, VIII, IX and X, and particularly at least one kind of metal selected from iron, nickel, cobalt, ruthenium, rhodium, palladium, platinum and rare-earth elements.

Further, the catalyst precursor compound may preferably be one which is vaporizable in a heating zone so as to provide a gas. Accordingly, it is preferred to use an organometallic compound such as metallacene, carbonyl compound and chloride. In addition, it is also possible to add to a main component as described above, a metal compound containing at least one element selected from Group I to XVII elements as a component for modifying the catalyst (so-called cocatalyst) so as to modify the performance of the metal catalyst as the main component. It is preferred to use a modifying component which is vaporizable in the heating zone.

The method of supplying the catalyst precursor compound to the heating zone is not particularly limited. The catalyst precursor compound can be supplied in a gaseous state, or in a liquid state which has been obtained by dissolving the catalyst precursor compound in a solvent, etc. The solvent to be used for such a purpose is not particularly limited. The solvent may appropriately be selected from those capable of dissolving a desired amount of the catalyst precursor compound to be supplied to the reaction system, such as water, alcohols, hydrocarbons, ketones and esters. It is preferred to use carbon compounds such as benzene, toluene and xylene, because such a solvent per se is usable as the carbon compound as the above-mentioned carbon source.

It is possible to disperse a catalyst precursor compound in a solid state which is substantially insoluble in a solvent, in a gas or liquid, so as to supply the resultant dispersion to the heating zone. In this case, it is recommended to prepare a good suspension, e.g., by adding a surfactant into the dispersion. However, the catalyst precursor compound in a solid state is generally less liable to be vaporized in the heating zone, and therefore the degree of the preference of such a method tends to be lowered in this viewpoint. When the catalyst precursor compound which is vaporizable in the heating zone is used, the resultant catalyst may desirably be the resultant catalyst may desirably contact with the above-mentioned additive in the heating zone and then be adsorbed and encapsulated uniformly into the additive.

The amount of the catalyst precursor compound to be added may preferably be 0.000001-1, more preferably 0.00001-0.1, most preferably and 0.0001-0.005, in terms of the ratio of in term of the ratio of the number of moles of the catalyst precursor compound the carbon atoms contained in the catalyst precursor compound, to the number of moles of carbon atoms contained in the entire raw materials (i.e., number of moles of the carbon atoms contained in the raw materials such as carbon compound). If the addition amount in terms of the above ratio is less than 0.000001, the amount of the catalyst becomes insufficient, and the resultant number of fibers undesirably tends to be decreased, or the fiber diameter undesirably tends to be increased. On the other hand, if the addition amount in terms of the above ratio exceeds 1, such a ratio is not preferred in an economical point of view, and further some catalyst particles having a larger particle size, which have not functioned as the catalyst, are liable to be mixed in the resultant fibers undesirably. Herein, in the case of the calculation of the above-mentioned molar ratio in the total number of carbon atoms contained in the raw materials, not only the carbon atoms derived from the carbon compound, but also those derived from the catalyst precursor compound, the additional component, and solvent should be included.

Conditions for Presence of Solid or Liquid Phase

The present invention is characterized in that a specific additional component, in addition to the carbon compound and catalyst precursor compound, is supplied to a heating zone, while setting the condition for the supply so that at least a portion of the additional component is present as a solid phase or a liquid phase in the heating zone. Based on the co-presence of the specific additional component, a meaningful or significant amount of carbon fibers can be grown, even by the use of a very small amount of the catalyst, and an improvement in the quality of the fiber to be produced (such as narrow diameter distribution) can be expected.

The role or function of the additional component is not necessarily be clarified, but it is presumably considered that the additional component may suppress the formation of larger particles due to the aggregation or agglomeration of catalyst particles in the heating zone, so as to enable the effective development and/or maintenance of the catalytic activity.

Based on such an effect of the present invention, carbon fibers can be obtained in a high yield, even by using a small amount of the catalyst which cannot provide carbon fibers in combination with the conventional methods. The mechanism of the actions in the present invention can presumably be considered as follows. Thus, catalyst particles originating from the catalyst precursor compound in the heating zone are adsorbed on the surface of the additional component, or encapsulate into the additional component, so as to prevent the aggregation and/or larger-size particle formation due to the collision of the catalyst particles with each other. Therefore, a sufficient amount of fibers can be produced, even by use of an extremely small amount of the catalyst which cannot provide a meaningful number of catalyst particles in the absence of the additional component.

Herein, the present invention does not encompass a conventional method wherein a metal such as iron and cobalt having a catalytic ability for producing carbon fibers is carried on a carrier such as alumina, and ten the resultant supported catalyst is supplied to a reactor. Alumina fine powder can be used as an additional component. However, in the present invention, an intentional action of causing a catalyst precursor compound to be immobilized or fixed on a carrier (such as the action of intentionally causing a catalyst precursor compound to be carried on alumina) is not conducted. Basically, in the present invention, the catalyst precursor compound is not immobilized on the additional component by a chemical interaction such as formation of a chemical bond, absorption and encapsulation (or inclusion), but the present invention is characterized in that each of the components is supplied without any chemical reaction to the heating zone of a reactor. For example, even in a case where ferrocene is used as a catalyst precursor compound, and activated carbon is used as an additional component, and both of these components are uniformly dispersed in benzene as a solvent, and the resultant dispersion is supplied to a reactor, the ferrocene is not substantially adsorbed into the activated carbon selectively so as to be concentrated. Tn the present invention, the ferrocene and the activated carbon are used in the state of a dispersion wherein both of these components are uniformly dispersed in benzene.

Method of Supplying Raw Materials

In the present invention, the method of supplying raw materials is not particularly limited. In other words, the raw materials can be supplied in various manners, such as (a) a method wherein both of the catalyst precursor compound and the additional component are dissolved or dispersed in a solvent, and these components are supplied in the state of the resultant solution or dispersion; or (b) a method wherein the catalyst precursor compound is vaporized and is supplied in a vapor phase, and the additional component is dissolved or dispersed in a solvent, and is supplied in the state of the resultant solution or dispersion; or further (c) a method wherein the catalyst precursor compound is supplied in a gaseous phase and the additional component is supplied in a solid phase. In the present invention, the former two methods (i.e., the above method (a) or (b)) are preferred.

In present invention, the process for providing a chemical interaction such as adsorption or encapsulation of a catalyst component into an additional component, is substantially conducted in a reactor. More specifically, in a case where a catalyst is preliminarily carried on a carrier, the particle size and particle size distribution of the resultant catalyst are greatly dependent on the conditions for the supported catalyst formation, and on the characteristic of the carrier per se such as pore distribution in the carrier. Further, in such a case, it is necessary to adopt complicated catalyst-preparing steps, and a pretreatment step for the catalyst, such as hydrogen reduction of the catalyst. On the contrary, in the present invention, the catalyst-preparing step and the pretreatment step for the catalyst can be omitted, and catalyst particles having a size which is effective for the growth of carbon fibers can be produced more effectively. As a result, in the present invention, a large amount of carbon fibers can be produced even by using a small amount of the catalyst.

Reaction in Heating Zone

In the present invention, the above-mentioned additional component should have a property such that at least a portion of the additional component is present in a solid phase or a liquid phase in the heating zone of a reactor for producing carbon fibers. Further, the additional component has a role or function of suppressing the aggregation or agglomeration of catalyst particles in the early or initial stage of the reaction. When the growth of carbon fibers is once initiated, the catalyst particles are included or encapsulate into the carbon fibers, and the role of the additional component is terminated. Therefore, it is considered that the vaporization or decomposition of the additional component causes substantially no problem in the later stage of the reaction.

In general, the reaction for converting a carbon compound into carbon fibers is conducted in a residence time of the order of seconds in the atmosphere of a special carrier gas such as hydrogen, at an elevated temperature of about 1000° C. Accordingly, in the present invention, it is preferred to select a compound as an additional component, at least a portion of which can be present as a solid or liquid state even under such a condition, to regulate the reaction conditions such as temperature and residence time of the heating zone, and the atmosphere in the heating zone so that at least a portion of the additional component can be present as a solid or liquid. In general, it is somewhat difficult to unambiguously determine these reaction conditions, since the reaction conditions may be changed variously depending on the kind of the carbon compound to be used, the intended product, etc.

For example, general range of the reaction condition may be as follows:

temperature: 500-1500° C., residence time: 0.001-100 seconds, atmosphere (carrier gas): inert gas such as nitrogen and argon, and hydrogen gas having a reducing property.

It is also possible to add a very small amount of oxygen, as desired. In the present invention, the phase during a residence time (which is considered to be a very short period in a general sense) in a special atmosphere is important, and therefore a compound having a boiling point which is not lower than the reaction temperature may, of course, satisfy this requirement. However, even in the case of a compound having a boiling point or decomposition temperature which is lower than the reaction temperature, such a compound may also satisfy the above-mentioned requirement, unless the compound is completely vaporized or decomposed within the residence time. Accordingly, some parameters such as boiling point and vapor pressure may be taken into consideration to a certain extent, but they are less liable to be an absolute scale for determining the adaptability of a compound of interest. Rather, it is practically useful to observe the actual state of a compound of interest under the actual reaction conditions (i.e., in what state the compound is present under the actual reaction conditions). For this purpose, it is preferred to recognize the presence of a predetermined solid or liquid in a recovery zone, when the compound to be tested per se is exposed to, or the compound to be tested is dissolved or dispersed in an appropriate solvent such as water (water is preferred, since it does not provide carbide as a residue) and the resultant solution or dispersion is exposed to an atmosphere which has been set to the actual reaction conditions. It is possible to define as an effective additional component, a compound which can remain (as at least a portion thereof) as a solid or liquid substantially without the vaporization or decomposition thereof, even if the compound is exposed to such a condition.

Even when a compound is once vaporized, the compound can again be converted into a liquid or solid, if the surrounding temperature is decreased. Accordingly, it is preferred to dispose the recovery zone in the immediate vicinity of the heating zone (e.g., at a site at which the temperature is maintained at 100° C. or higher, more preferably 200° C. or higher). However, when the additional component is not water-soluble and a hydrocarbon-type solvent is used, the solvent per se can be carbonized so as to remain as a residual solid. In such a case, it is practically difficult to distinguish the residue of the additional component from the residue of the solvent. As described above, in some cases, it may be difficult to recognize a fact that all of the additional component is not vaporized by using the above-mentioned test. However, the above-mentioned method can basically provide an index for determining whether the compound can effectively function in the present invention.

Further, as shown in Example 4 and Comparative Example 2 appearing hereinafter, in the case of the same additional component, the effect thereof is exhibited when the additional component is dissolved in a solvent and is introduced into the heating zone by spraying the resultant solution; but the effect thereof is not recognized when a vaporizing zone is provided, and a liquid including the additional component is supplied to the vaporizing zone so as to be vaporized, and then the resultant vapor is introduced into the reactor. Accordingly, it is important to recognize the state of the component under the reaction conditions (including the method of feeding the raw materials).

The boiling points or decomposition temperatures of various compounds such as those described in Kagaku Binran Kiso-Hen (Handbook of Chemistry, Basic Division), Revised 4th edition, edited by Chemical Society of Japan, published by Maruzen K. K. (1993); CRC Handbook of Chemistry and Physics (CRC Press Inc.), etc., are very useful for the purpose of selecting an additional component which is suitable for the present invention. Preferred examples of the additional component usable in the present invention may include the following compounds:

(a) Inorganic compounds having a predetermined temperature (which is the lower temperature selected from the decomposition temperature thereof or the boiling point thereof under normal pressure) of 180° C. or higher, more preferably 300° C. or higher, further preferably 450° C. or higher, most preferably 500° C. or higher; wherein the decomposition temperature is defined as the temperature at which the compound to be tested provides a weight (or mass) loss of 50%, when about 10 mg of a sample of the compound to be tested is subjected to a temperature increase of 10° C./min in the atmosphere of an inert gas by using a thermal analyzer;

(b) Organic compounds having a predetermined temperature (which is the lower temperature selected from the decomposition temperature thereof or the boiling point thereof under normal pressure) of 180° C. or higher, more preferably 300° C. or higher, further preferably 350° C. or higher, most preferably 400° C. or higher; and (c) organic polymers having a molecular weight (i.e., number-average molecular weight after the polymerization therefor) of 200 or higher, more preferably 300 or higher, further preferably 400 or higher.

Alternatively, the additional component may also be a compound such that it can be converted into an inorganic compound having a predetermined temperature (which is the lower temperature selected from the decomposition temperature thereof or the boiling point thereof under normal pressure) of 180° C. or higher, more preferably 300° C. or higher, further preferably 450° C. or higher, most preferably 500° C. or higher.

Measurement of Decomposition Temperature

In the measurement of the above-mentioned decomposition temperature, for example, as described in Examples appearing hereinafter, the decomposition temperature may also be defined as the temperature at which the compound to be tested provides a weight loss of 50 mass %, when about 10 mg of a sample of the compound to be tested is subjected to a temperature increase of 10° C./min to 600° C. under nitrogen gas (flow rate: 200 cc/min) by using a differential thermal analyzer (DTA-TG SSC/5200 mfd. by Seiko Instruments Co.).

Additional Component (1)

Preferred examples of the inorganic compound which are useful as the additional component (1) may include: inorganic compounds containing at least one kind of element selected from the Group II-XV elements in the 18-Group type periodic table of elements; more preferably, inorganic compounds containing at least one kind of element selected from Mg, Ca, Sr, Ba, Y, La, Ti, Zr, Cr, Mo, W, Fe, Co, Ni, Cu, Zn, B, Al, C, Si and Bi. It is possible to use any of these metals in a simple substance or an element per se, but it is generally unstable, and there is a problem in the handling and stability thereof. Accordingly, it is recommended to use the above element as an oxide, nitride, sulfide, carbide, and double salts derived from at least two of these compounds. Ii is also possible to use a compound which can be decomposed under heating so as to provide any of these compounds, such as sulfate, nitrate, acetate, hydroxide, etc. Further, carbon may be used as a simple substance, and activated carbon or graphite can effectively be used. In addition, it is also possible to use carbon fibers per se as an additional component. However, in view of easiness and convenience at the time of feeding thereof, carbon fibers having a larger aspect ratio is not preferred, but it is preferred to use carbon fibers having an aspect ratio of not smaller than 1 (one) and not larger than 50, and having an average fiber diameter of not smaller than 10 nm and not larger than 300 nm. The aspect ratio can be determined by measuring the fiber diameters and fiber lengths with respect to 100 or more fibers by use of an electron microscope photograph, and determining the average of (fiber length)/(fiber diameter).

Specific examples of these inorganic compounds may include: zinc oxide, aluminum oxide, calcium oxide, chromium (II, III, VI) oxide, cobalt (II, III) oxide, cobalt (II) aluminum oxide, zirconium oxide, yttrium oxide, silicon dioxide, strontium oxide, tungsten (IV, VI) oxide, titanium (II, III, IV) oxide, iron (II, III) oxide, zinc iron (III) oxide, cobalt (II) iron (III) oxide, iron (III) iron (II) oxide, copper (II) iron (III) oxide, copper (I, II) oxide, barium iron (III) oxide, nickel oxide, nickel (II) iron (III) oxide, barium oxide, barium aluminum oxide, bismuth (III) oxide, bismuth (IV) oxide dihydrate, bismuth (V) oxide, bismuth (V) oxide monohydrate, magnesium oxide, magnesium aluminum oxide, magnesium iron (III) oxide, molybdenum (IV, VI) oxide, lanthanum oxide, lanthanum oxide iron, zinc nitride, aluminum nitride, calcium nitride, chromium nitride, zirconium nitride, titanium nitride, iron nitride, copper nitride, boron nitride, zinc sulfide, aluminum sulfide, calcium sulfide, chromium (II, III) sulfide, cobalt (II, III) sulfide, titanium sulfide, iron sulfide, copper sulfide (I, II), nickel sulfide, barium sulfide, bismuth sulfide, molybdenum sulfide, zinc sulfate, ammonium zinc sulfate, aluminum sulfate, ammonium aluminum sulfate, ammonium chromium sulfate, yttrium sulfate, calcium sulfate, chromium (II, III) sulfate, cobalt (II) sulfate, titanium (III, IV) sulfate, iron (II, III) sulfate, ammonium iron sulfate, copper sulfate, nickel sulfate, ammonium nickel sulfate, barium sulphate, bismut sulfate, magnesium sulphate, zinc nitrate, aluminum nitrate, yttrium nitrate, calcium nitrate, chromium nitrate, cobalt nitrate, nitrate zirconium, bismuth nitrate, iron nitrate (II, III), cupric nitrate, nickel nitrate, barium nitrate, magnesium nitrate, manganese nitrate, zinc hydroxide, aluminum hydroxide, yttrium hydroxide, calcium hydroxide, chromium (II, III) hydroxide, cobalt hydroxide, zirconium hydroxide, iron (II, III) hydroxide, copper (I, II) hydroxide, nickel hydroxide, barium hydroxide, bismuth hydroxide, magnesium hydroxide, zinc acetate, cobalt acetate, copper acetate, nickel acetate, Fe acetate, activated carbon, graphite, carbon fibers, zeolite (aluminosilicate), calcium phosphate, aluminum phosphate, etc.

Supplying to Heating Zone

In order to continuously supply such an inorganic compound into the heating zone of a reactor, for example, it is possible to conduct the supplying by a method wherein fine powder having an average particle size of 100 μm or less is dispersed in a solvent, and spraying the resultant dispersion into the reactor. In addition, in view of the provision of an effective area sufficient for the adsorbing of catalyst particles, the particle size may preferably have a smaller value. The average particle size may preferably be not larger than 100 μm, more preferably not larger than 50 μm, further preferably not larger than 30 μm, most preferably not larger than 10 μm. Similarly, the maximum diameter may preferably have a smaller value. More specifically, the maximum diameter may preferably be not larger than 200 μm, more preferably not larger than 100 μm, further preferably not larger than 50 μm, most preferably not larger than 30 μm. With respect to the details of the definition of and measurement method for this "average particle size", e.g., Kagaku Kogaku Binran (Handbook of Chemical Engineering), p 657 et seq.), Maruzen, 1964, 4th edition, may be referred to.

Examples of most preferred additional component may include: those in the form of powder which are easily available industrially, such as graphite, silica, alumina, magnesia, titania, zirconium oxide, zeolite, calcium phosphate, aluminum phosphate, activated carbon preferably having an average particle size of not larger than 100 μm, and carbon fibers having an aspect ratio of not larger than 50.

Additional Component (2) and (3)

When an organic compound of the additional component (2) or an organic polymer of the additional component (3) is used, the affinity thereof with a catalyst precursor compound, etc., may also be an important factor in view of an improvement in the effect of the additional component. Therefore, in addition to the above-mentioned compounds having a preferred property in view of the boiling point, decomposition temperature, and molecular weight, in many cases, an organic compound having a hetero-atom such as oxygen, nitrogen, sulfur and phosphorus is more effective than a simple hydrocarbon. Further, in a case where a hydrocarbon which is liquid at normal temperature such as benzene and toluene is used as the carbon source for carbon fibers, any organic compound which is soluble in such a hydrocarbon is preferred in view of easy feeding thereof.

Specific examples of the organic compound as the additional component (2) and of the polymer usable as the additional component (3) may include at least one kind of organic compound selected from the group including: higher alcohol, olefins, and saturated and unsaturated hydrocarbons having a carbon number of ten or more; halogenated ethylenes; dienes; acetylene derivatives, styrene derivatives, vinyl ester derivatives, vinyl ether derivatives, vinyl ketone derivatives, acrylic acid/methacrylic acid derivatives, acrylic acid ester derivatives, methacrylic acid ester derivatives, acrylic amide/methacryl amide derivatives, acrylonitrile/methacrylonitrile derivatives, maleic acid/maleimide derivatives, vinyl amine derivatives, phenol derivatives, melamine and urea derivatives, amine derivatives, carboxylic acid/carboxylic acid ester derivatives, diol polyol derivatives, isocyanate/isothiocyanate derivatives; and polymers of these organic compounds.

In view of the economic advantage and universal applicability, more preferred examples of the above compound may include: octyl alcohol, decyl alcohol, cetylalcohol, stearyl alcohol, oleic acid, stearic acid, adipic acid, linoleic acid, erucic acid, behenic acid, myristic acid, lauric acid, capric acid, caprylic acid, hexanoic acid and sodium and potassium salt thereof; malonic acid dimethyl ester, maleic acid dimethyl ester, phthalic acid dibutyl ester, phthalic acid ethyl hexyl ester, phthalic acid di-isononylester, phthalic acid di-isodecyl ester, phthalic acid diundecyl ester, phthalic acid ditridecyl ester, phthalic acid di-butoxyethyl ester, phthalic acid ethyl hexyl benzil ester, adipic acid ethyl hexyl ester, adipic acid di-isononyl ester, adipic acid di-isodecyl ester, adipic acid dibutoxyethyl ester, trimellitic acid ethyl hexyl; polyethylene glycol, polypropylene glycol, polyoxyethylene glycol monomethyl ether, polyoxyethylene glycol dimethyl ether, polyoxyethylene glycol glycerin ether, polyoxyethylene glycol lauryl ether, polyoxyethylene glycol tridecylether, polyoxyethylene glycol cetyl ether, polyoxyethylene glycol stearyl ether, polyoxyethylene glycol oleyl ether, polypropylene glycol diallyl ether, polyoxyethylene glycol nonyl phenyl ether, polyoxyethylene glycol octyl ether, stearic acid polypropylene glycol; di 2-ethylhexyl sulfo succinic acid sodium salt, polyethylene oxide, polypropylene oxide, polyacetal, polytetrahydrofuran, polyvinyl acetate, poly vinyl alcohol, polyacrylic acid methyl ester, poly methyl methacrylate, polyethylene, polypropylene, polyvinyl chloride, polyvinylidene chloride, polyurethane, unsaturated polyester, epoxy resin, phenolic resin, a poly carbonate, polyamide, poly phenylene oxide, polyacrylonitrile, polyvinyl pyrrolidone, etc.

When an organic compound is used as the additional component, the organic compound per se is also constituted by carbon atoms. Accordingly, in some cases, it is possible to expect that the organic compound is present as a solid phase or liquid phase in the early stage of the reaction, so as to suppress the aggregation (or agglomeration) of catalyst particles, and in the later stage of the reaction or the subsequent heat treatment, the organic compound is vaporized, decomposed into a volatile state, or is encapsulate into the product as carbon fibers. The selection of the compound showing such a property is highly advantageous, because fibers containing little or substantially no impurity can be obtained without conducting a particular purification treatment. The aggregation of catalyst particles can be suppressed by using a catalyst comprising a metal supported on a carrier such as alumina. However, according to the method of the present invention, a catalyst having an appropriate particle size can be produced in the reactor, and further, such a state can be maintained, and can also exhibit an effect of showing substantially no trace of the carrier. Accordingly, the present invention is much more efficient and effective, as compared with the method of utilizing the conventional supported catalyst.

Addition Amount of Additional Component

The amount of an additional component to be added may preferably be 0.001-10000, more preferably 0.01-1000, and most preferably 0.1-100, in terms of the mass ratio of the additional component to the metal contained in a catalyst. When this addition amount is less than 0.001, the amount of the carbon fibers to be produced can be decreased. On the other hand, when this addition amount exceeds 10000, the effect thereof is not substantially improved, and rather powdery carbon product is liable to be increased undesirably.

Herein, of course, the additional component to be used in the present invention does not encompass the carbon compound and the catalyst precursor as the carbon source.

Each of the carbon compound, the catalyst precursor compound, and the additional component can be introduced individually into a reaction system, but it is preferred that these components are mixed and/or dissolved with each other, and the resultant mixture is supplied to the reactor so as to simultaneously supply these components to the reactor.

Carrier Gas

In the process for producing vapor-grown carbon fibers according to the present invention, it is recommended to use a carrier gas, in addition to the above-mentioned components or composition. As the carrier gas, it is possible to use hydrogen, nitrogen, carbon dioxide, helium, argon, krypton, or gas mixture of at least two of these gases. However, it is less preferred to use a gas containing oxygen molecules (i.e., oxygen in the state of molecule: $O_2$) such as air. The catalyst precursor compound to be used in the present invention can be in an oxidized state in some cases, and in such a case, it is preferred to use a gas containing hydrogen as the carrier gas. Accordingly, preferred examples of the carrier gas may include a gas containing 1 vol. % or more, more preferably 30 vol. % or more, and most preferably 85 vol. % or more of hydrogen, such as 100 vol. % of hydrogen, and hydrogen diluted with nitrogen.

Sulfur Compound

Further, it is possible to use a sulfur compound which is considered to be effective in the control of the carbon fiber diameter, in combination with the above-mentioned components. For example, it is possible that a compound such as sulfur, thiophene and hydrogen sulfide is supplied in a gaseous state to the reaction system, or is dissolved or dispersed in a solvent and is supplied to the reaction system. Of course, it is also possible to use a substance containing sulfur as the carbon compound, the catalyst precursor compound, and/or the additional component. The total number of moles of sulfur to be supplied may preferably be not larger than 1000 times, more preferably not larger than 100 times, further preferably not larger than 10 times the number of moles of metal contained in the catalyst. If the amount of the sulfur is too large, not only such an amount is not economically advantageous, but also it may undesirably suppress the growth of the carbon fibers.

Synthesis of Carbon Fibers

The vapor-grown carbon fibers can be synthesized by supplying the raw materials as described hereinabove (and a carrier gas, as desired) are supplied to a heating zone so that the raw materials are caused to react each other under heating. The reactor (or heating furnace) to be used in the present invention is not particularly limited, as long as it can provide a predetermined residence time, and a predetermined heating temperature. It is preferred to use a tube furnace of vertical type or horizontal type, in view of the feeding of the raw materials, and the control of residence time. It is preferred to appropriately adjust the reaction conditions, and to appropriately select the additional component so that at least a portion of the additional component is present as a solid or liquid in the heating zone. Such a reaction condition is not particularly limited, as long as the condition can change the volatility and decomposition property of the additional component. In general, specific examples of the above conditions may include: the temperature of the heating zone, the residence time, the feeding concentration of the additional component, the method of feeding the raw materials such as the additional component, etc.

The temperature of the heating zone may considerably be different depending on the carbon compound to be used, and the kind of the additional component. In general, the temperature of the heating zone may preferably be not lower than 500° C. and not higher than 1500° C., more preferably not lower than 600° C. and not higher than 1350° C. If the temperature is too low, the carbon fibers are less liable to be grown. On the other hand, if the temperature is too high, it is possible that the additional component is converted into a gaseous state in the heating zone and the effect of the addition of the additional component is not exhibited, and further only fibers having a larger diameter are produced.

The residence time can be controlled by the length of the heating zone, and by the flow rate of the carrier gas. The residence time may considerably be changed depending on the reactor to used, and the kind of the carbon compound. The residence time may generally be 0.0001 second to 2 hours or less, more preferably 0.001-100 seconds, and most preferably 0.01-30 seconds. If the residence time is too short, the carbon fibers are less liable to be grown. On the other hand, if the residence time is too long, it is possible that the additional component is converted into a gaseous state in the heating zone and the effect of the addition of the additional component is not exhibited, and further only fibers having a larger diameter are produced.

The concentration of the additional component to be supplied can be controlled by the flow rate of the carrier gas, and rate of supplying the carbon compound. It is possible to appropriately select the concentration of the additional component, depending on at least one of the other conditions such as the reactor to used, the kind of the carbon compound and the additional component. The preferred concentration of the additional component may preferably be 0.0000001-100 g/NL, more preferably 0.000001-10 g/NL, most preferably 0.00001-1 g/NL, in terms of the mass of the additional component in the carrier gas. Herein, the volume of the carrier gas is expressed in terms of the volume thereof at standard condition. When the concentration to be supplied is too low, the additional component tends to be converted into a gaseous state in the heating zone, and the effect of the added additional component is less liable to be produced.

The method of supplying the additional component is not particularly limited, but may appropriate be adjusted depending on the reaction conditions such as the additional component to be used, and the concentration of the additional component to be added, so that at least a portion of the additional component is present as a solid or liquid in the heating zone. Preferred examples of the above feeding method may include: a method wherein the additional component is supplied to the heating zone in the state of a liquid, or a solution or a dispersion thereof which has been obtained by dissolving or dispersing the additional component in a liquid; a method wherein the catalyst precursor compound and the additional component are dissolved or dispersed in the same liquid (which can be a carbon source, as desired) and are supplied to the heating zone; a method wherein the catalyst precursor compound is supplied in a gaseous state, and the additional component is dissolved or dispersed in a liquid (which can be a carbon source, as desired) and is supplied to the heating zone. It is preferred to supply these liquid components containing the additional component by using a spraying nozzle disposed in a reaction tube.

Spraying Nozzle

Figure 5:
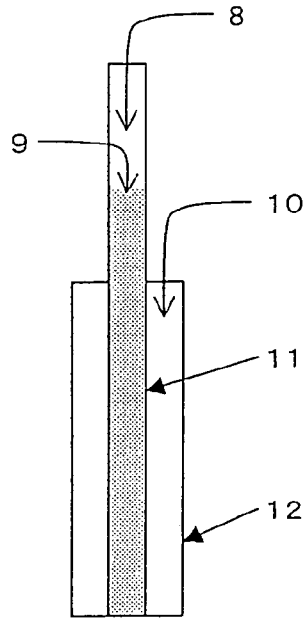
FIG. 5 is a schematic sectional view showing a duplex-tube nozzle which has been used in Examples 10 and 11, and Comparative Example 4.
Figure 6:
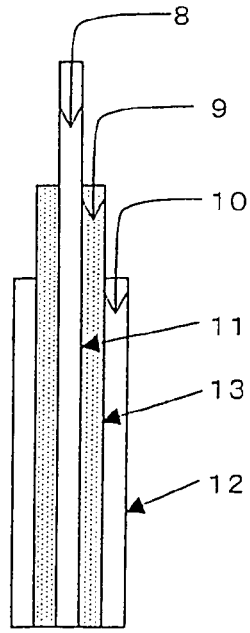
FIG. 6 is a schematic sectional view showing a triplex-tube nozzle which has been used in Examples 1-7 and 9, and Comparative Examples 1 and 3.

The form or shape of the spraying nozzle usable in the present invention is not particularly limited. Specific examples thereof may include: nozzles having various structure such as multiple-pipe type, single-fluid type, and double-fluid type. Further, it is also possible to use a nozzle having any of structures such as internal mixing-type wherein a liquid component and a gas component such as carrier gas are mixed with each other in the nozzle; and external mixing-type wherein a liquid component and a gas component such as carrier gas are mixed with each other outside of the nozzle. Particularly preferred examples of the multiple pipe structure may include those as shown in FIGS. 5 and 6, wherein FIG. 5 shows the double pipe structure, and FIG. 6 shows the triple pipe structure.

The spraying nozzle can be disposed on any of the sites such as the middle and inlet portions of the reactor tube. It is also possible to insert the discharge portion of the spraying nozzle into the reaction tube. In any of these cases, it is important to control the tip temperature of the discharge nozzle, the discharge rate of a gas component such as carrier gas, and a liquid component including the additional component, so as to maintain at least a portion of the additional component in a solid or liquid state in the heating zone.

The temperature of the discharge nozzle tip is somewhat depending on the kind of the additional component to be used, and on the form or shape of the spraying nozzle, but the temperature of the discharge nozzle tip may preferably be 200° C. or lower, more preferably 150° C. or lower, most preferably 100° C. or lower. In order to maintain such a temperature condition, it is preferred to adjust the position of the spraying nozzle to be disposed, or to equip the spraying nozzle with a cooling system or cooling mechanism. The cooling system to be used for such a purpose is not particularly limited, as long as it can maintain the temperature of the discharge portion of the nozzle at a predetermined temperature. For example, it is preferred that a cooling jacket is disposed on the outside of the spraying nozzle, and a medium such as water or any of various inert gases is circulating in the cooling jacket so as to cool the spraying nozzle. When the temperature of the nozzle discharge portion exceeds 200° C., spherical carbon particles are liable to be mixed in the product.

In the case of a single-fluid type nozzle, the discharge rate from the nozzle discharge portion can easily be determined. However, in the case of a fluid nozzle having a complicated structure such as multiple-tube nozzle, it is generally difficult to determine the discharge rate from the nozzle discharge portion. Even in such a case, the discharge rates of the respective liquid component and a carrier gas component are very useful for predicting the state of the spraying. For example, in the case of the multiple-tube nozzle as shown in FIG. 5 and FIG. 6, each discharge rate can be determined by dividing the flow rates of the carrier gas and the liquid component including the additional component by the cross sectional area of each flow path. Particularly, in the case of the internal mixing type nozzle as shown in FIG. 5, the liquid component is ejected together with the carrier gas, and therefore it is presumably considered that the discharge rate of the liquid component is the same as the discharge rate of the carrier gas to be internally mixed in the nozzle. In particular, in the case of the spraying nozzle of the internal mixing type, each of the discharge rates which have been calculated in this way may preferably be not larger than 30 m/s, and most preferably not larger than 10 m/s. If the discharge rate exceeds 30 m/s, spherical carbon particles are liable to be mixed in the product undesirably.

EXAMPLES

Hereinbelow, the present invention will be described in more detail with reference to Examples, but the present invention is not limited to these Examples.

The chemical reagents, etc., which had been used in the following Examples and Comparative Examples are as follows.

Chemical Reagents

1. Carbon Compounds

Benzene: Guaranteed reagent mfd. by Wako Pure Chemical Industries, Ltd.

2. Catalyst Precursor Compounds

Ferrocene: mfd. by Nippon Zeon Co., Ltd.

$FeCl_3$: Reagent mfd. by Wako Pure Chemical Industries, Ltd.

$CoCl_2$: Reagent mfd. by Wako Pure Chemical Industries, Ltd.

3. Additional Components

Polypropylene glycol: D-250 (molecular weight: 250, decomposition temperature 220° C.), mfd. by Nippon Oil & Fats Co., Ltd.

D-400 (molecular weight: 400, decomposition temperature 290° C.) mbd. by Nippon Oil & Fats Co., Ltd.

AOT (di-isooctyl sodium sulfosuccinate salt): DTP-100 (molecular weight: 444, decomposition temperature 290° C.) mfd. by Nikko Chemicals Co., Ltd.

Fumed silica: HS-5 mfd. by CABOT Co. (molecular weight: 60, boiling point: 2230° C.)

Dibutyl phtalate: Wako Pure Chemical Industries, Ltd. (molecular weight: 278, the boiling point: 339° C.)

Carbon fibers: A product which had been obtained by pulverizing VGCF-C mfd. by Showa Denko K.K. with a vibrating mill, and then graphitizing the resultant pulverized product at 2800° C. in argon (average fiber diameter: 150 nm, average aspect ratio: 5)

Activated carbon: Kuraray Coal YP-17 mfd. mfd. by Kuraray Co., Ltd. (decomposition temperature: 600° C. or higher)

4. Other Components

Sulfur (powder): Reagent mfd. by Kanto Chemical Co., Ltd.

Measurement of Decomposition Temperature

The decomposition temperature of the additional component was determined by heating about 10 mg of a sample to be measured to 600° C. at a temperature increasing rate of 10° C./min under a nitrogen gas flow rate of 200 cc/min in a differential thermal analyzer (DTA-TG SSC/5200, mfd. by Seiko Instruments Co.). At this time, the temperature at which a weight decrease of 50 mass % was provided was read, and this temperature was treated as the decomposition temperature. When the weight decrease did not reach 50 mass % even if the sample was heated to 600° C., the decomposition temperature was treated as "600° C. or higher".

Synthesis of Carbon Fibers

Examples 1-7

Figure 2:
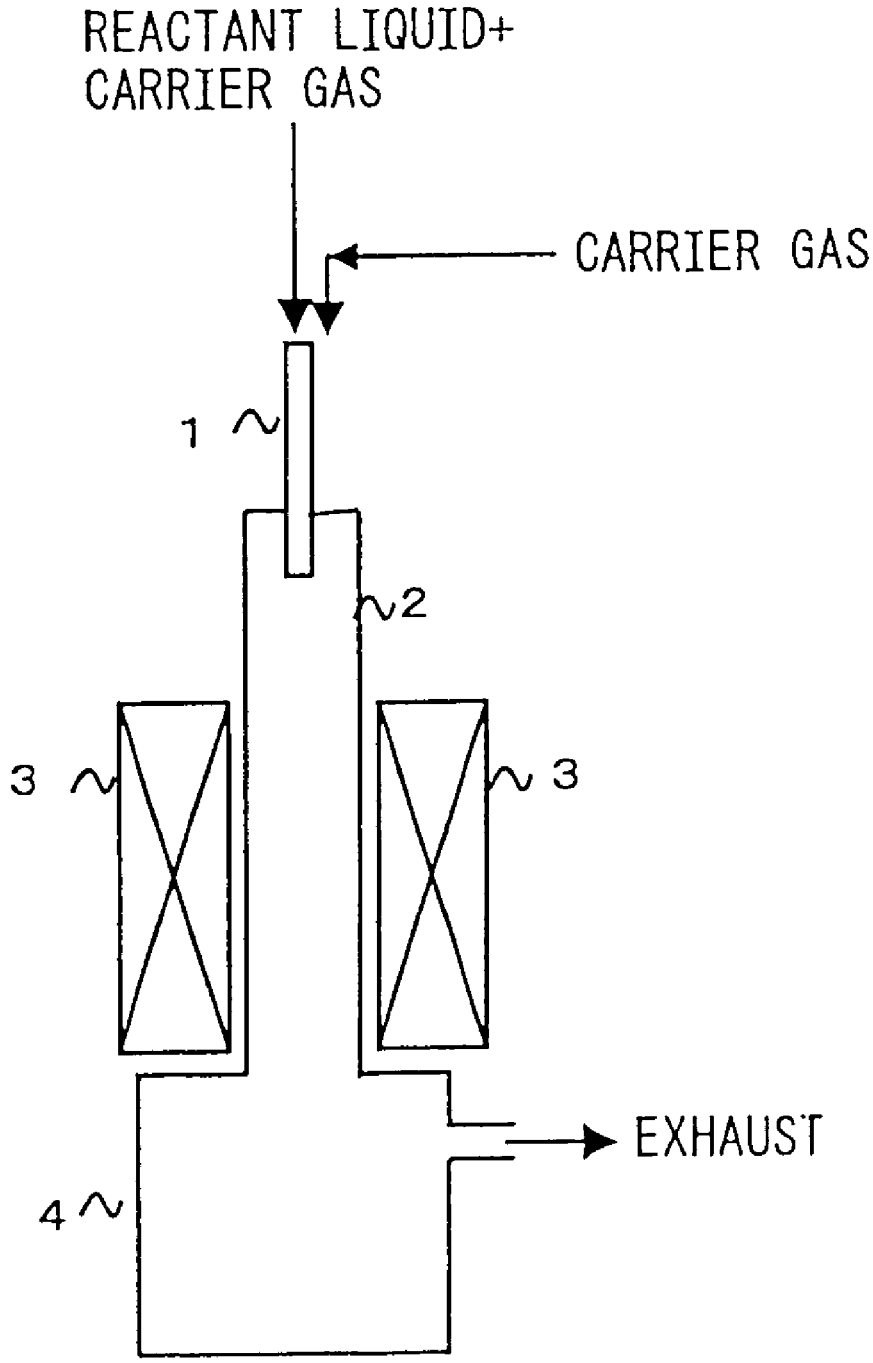
FIG. 2 is schematic sectional view showing the reactor which has been used for producing vapor-grown carbon fibers in Examples 1-7 and 9-11, and Comparative Examples 1, 3 and 4.

A vertical-type furnace equipped with a reaction tube 2 made of quartz (inside diameter 31 mm, outside diameter 36 mm, length of heating zone about 400 mm) as shown in FIG. 2 was used. The temperature in this furnace was increased to 1250° C. under a stream of $N_2$, and thereafter the supply of $N_2$ was stopped, and instead, $H_2$ was flown into the reaction tube as a carrier gas at 1 NL/min. After the temperature was stabilized, a reactant liquid (wherein benzene was used as both a solvent or a dispersion medium, and a carbon compound) as shown in Table 1 appearing hereinafter was supplied from a raw material-spraying nozzle 1 at a flow rate of 0.11 g/min for 10 minutes by use of a small-sized pump. The carrier gas was supplied at rates of 0.3 NL/min and 0.7 NL/min, respectively, to the outside and inside of the spraying nozzle having a structure as shown in FIG. 6. When the discharge rates were calculated from the cross sectional area of the flow paths of the spraying nozzle, they were 3 m/S and 60 m/S, respectively. The temperature of the discharge portion of the spraying nozzle was 75° C. Herein, the compositions to be supplied were expressed in the Table in terms of mass % in the benzene solution. Ethyl acetate used in Example 2 was added so as to increase the solubility of $FeCl_3$ in benzene.

As a result of the reaction, cobweb (or spider's web)-shaped deposit having a grayish color was generated in the bottom of the reaction tube. After the temperature was lowered, this deposit was collected, and the carbon recovery percentage was determined by dividing the amount of the recovered deposit by the amount of benzene used in this reaction. Further, the fibrous product was observed with a scanning electron microscope. The results of this observation are shown in Table 2 appearing hereinafter.

In addition, in each of these Examples, the components other than the additional component were replaced with water, the additional component was dissolved or dispersed in water, and the resultant mixture was sprayed into the reaction tube under the conditions which were same as those in each of the corresponding Examples. As a result, in these experiments, it was confirmed that the additional component was collected in a liquid or solid state in the recovery portion.

Example 8

Figure 3:
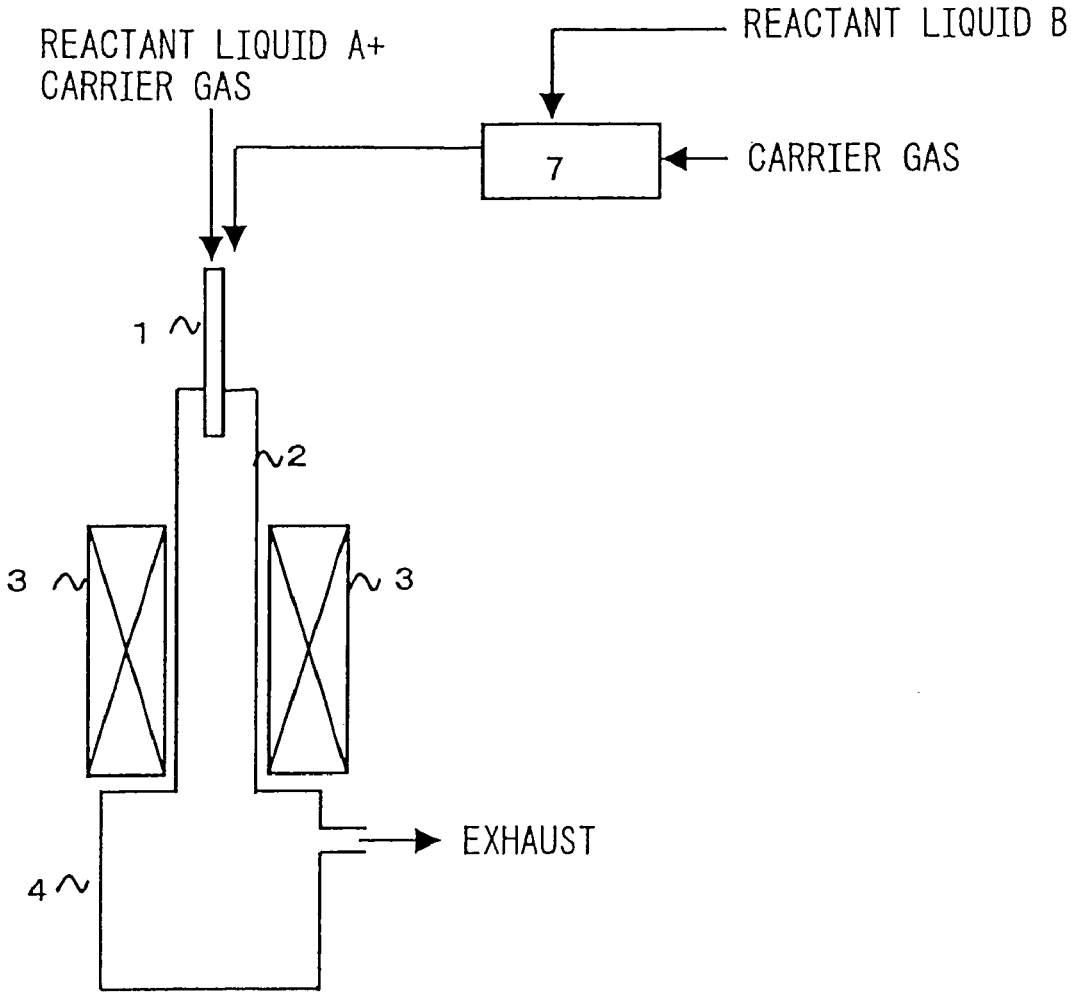
FIG. 3 is a schematic sectional view showing the reactor which has been used in Example 8 for producing vapor-grown carbon fibers.

By use of a reactor as shown in FIG. 3, a reactant liquid A comprising polypropylene glycol (D-400), sulfur and benzene (composition of the liquid A: polypropylene glycol (D-400): sulfur:benzene=0.30:0.03:99.67 mass %) was supplied from the raw material-spraying nozzle 1 at 0.11 g/min with a small-sized pump. On the other hand, a reactant liquid B comprising ferrocene and benzene (composition of the liquid B: ferrocene:benzene=3.33:96.67 mass %) was introduced at 0.003 g/min into the vaporizer 7 (which had been heated to 200° C.) by using a small-sized pump so that the ferrocene and an extremely small portion of benzene were supplied in the gaseous state together with the carrier gas. The flow rates of the carrier gas ($H_2$) was set to 0.7 NL/min for the reactant liquid A side, and 0.3 NL/min for the reactant liquid B side, respectively. A raw material-spraying nozzle having a triple-pipe structure as shown in FIG. 6 was used; the flow rates of the carrier gas were 0.2 NL/min and 0.5 NL/min, respectively, for outside and inside portion of the nozzle; and the discharge rates were 2 m/s and 43 m/s, respectively. The temperature of the discharge portion of the spraying nozzle was 75° C. The same operations as those in Examples 1-7 were repeated except that the above-described conditions were respectively used in each of the corresponding Examples. The thus obtained results are shown in Table 2 appearing hereinafter.

Comparative Example 1

The synthesis was conducted in the same manner as in Example 1 except for using a reactant liquid having a composition as shown in Table 1 appearing hereinafter.

As a result, the reaction product mainly comprised spherical carbon powder, and an extremely small amount of fibrous product was produced.

Comparative Example 2

Figure 4:
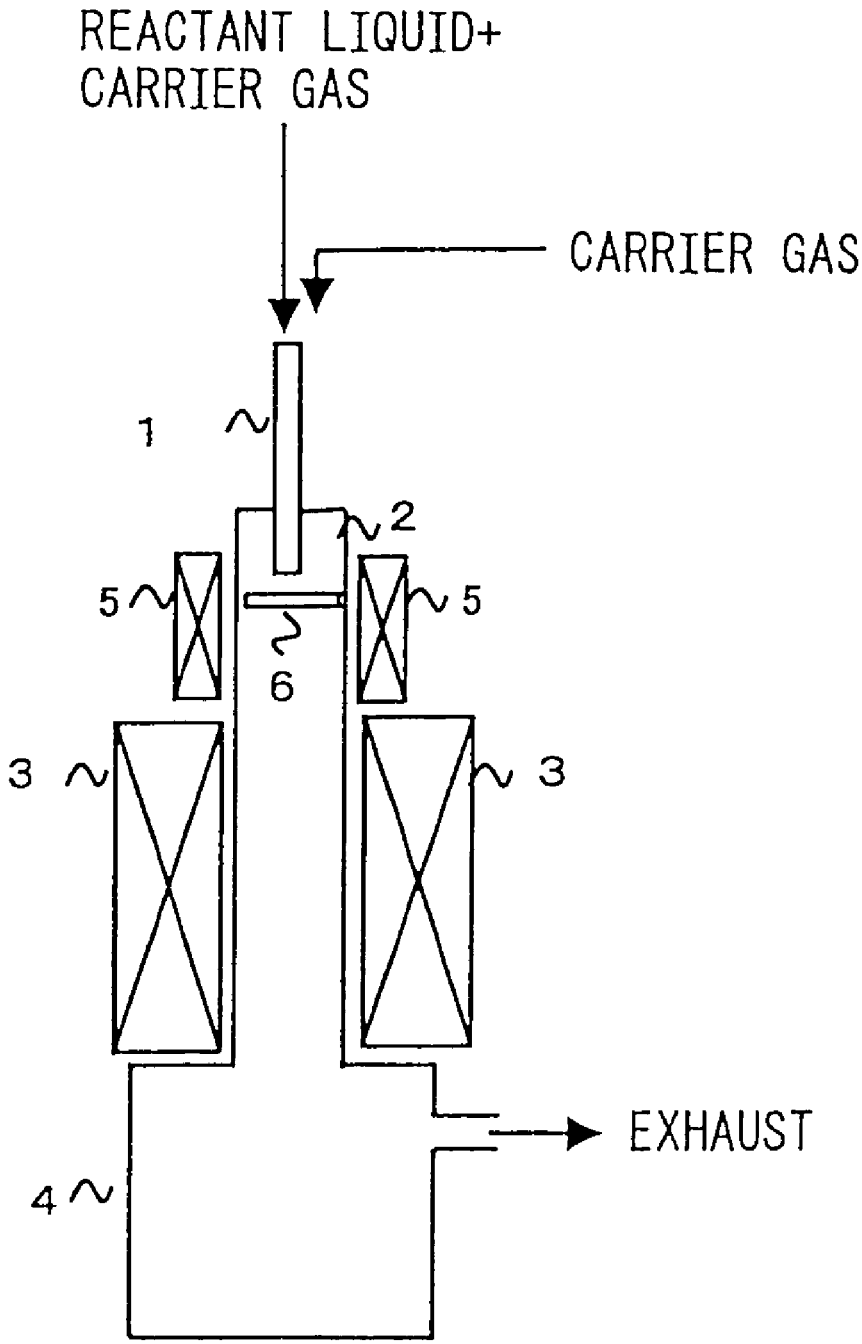
FIG. 4 is a schematic sectional view showing the reactor which has been used in Comparative Example 2 for producing vapor-grown carbon fibers, which has a heater in the raw material-introducing portion thereof.

An apparatus in FIG. 4 was used as the reactor. In this reactor, a vaporizing heater 5 and a plate 6 were disposed in the raw material-introducing portion of the reactor shown in FIG. 2. The operations were conducted in the same manner as in Example 4, except that the temperature of the vaporizing heater 5 was set to 300° C., and the reactant composition (reactant liquid) was completely vaporized and then was introduced into the heating zone.

As a result, the reaction product mainly comprised spherical carbon powder, the recovery percentage was 37%, and an extremely small amount of fibrous product was produced.

Example 9

Comparative Example 3

The reaction was conducted under the same conditions as those in Example 1, except that the temperature of the discharge portion of the spraying nozzle was set to the temperature as shown in Table 1, by changing the position of the insertion of the raw material-spraying nozzle into the reaction tube as shown in FIG. 2.

Example 11

Comparative Example 4

In these examples, the double-pipe type nozzle shown in FIG. 5 was used, the total amount of the carrier gas was set to 1 NL/min (constant), so as to provide the conditions as shown in Table 1. In these examples, the carrier gas was supplied through the outside and the inside of the spraying nozzle, and the carrier gas was directly supplied to the reaction tube without using the nozzle. The reaction was conducted under the same conditions as those in Example 1, except that the conditions as shown in Table 1 were used.

TABLE 1

| | | | Examples | | | | | | | | | | | | Comp. Ex. | | | |
|---|---|---|---|---|---|---|---|---|---|---|---|---|---|---|---|---|---|---|
| | | | 1 | 2 | 3 | 4 | 5 | 6 | 7 | 8 | | 9 | 10 | 11 | 1 | 2 | 3 | 4 |
| reactant liquid | carbon compound | benzene | 99.59 | 97.47 | 99.29 | 99.59 | 91.90 | 99.59 | 99.59 | 99.67 | 96.67 | 99.59 | 99.59 | 99.59 | 99.89 | 99.59 | 99.59 | 99.59 |
| | | ethyl acetate | | 2.00 | | | | | | | | | | | | | | |
| | | ethanol | | | | | 5.00 | | | | | | | | | | | |
| | catalyst precursor compound | ferrocene | 0.08 | | 0.08 | 0.08 | | 0.08 | 0.08 | | 3.33 | 0.08 | 0.08 | 0.08 | 0.08 | 0.08 | 0.08 | 0.08 |
| | | $FeCl_3$ | | 0.20 | | | | | | | | | | | | | | |
| | | $CoCl_2$ | | | | | 2.20 | | | | | | | | | | | |
| | additive | PPG (250) | 0.30 | | | | | | | | | 0.30 | 0.30 | 0.30 | | | 0.3 | 0.3 |
| | | PPG (400) | | | | | | | | 0.30 | | | | | | | | |
| | | AOT | | 0.30 | | | 0.40 | | | | | | | | | | | |
| | | fumed silica | | | 0.60 | | | | | | | | | | | | | |
| | | dibutyl phthalate | | | | 0.30 | | | | | | | | | | 0.30 | | |
| | | activated carbon | | | | | | 0.30 | | | | | | | | | | |
| | | carbon fiber | | | | | | | 0.30 | | | | | | | | | |
| | other components | sulfur | 0.03 | 0.03 | 0.03 | 0.03 | 0.50 | 0.03 | 0.03 | 0.03 | | 0.03 | 0.03 | 0.03 | 0.03 | 0.03 | 0.03 | 0.03 |
| conditions | carrier gas (outside) | flow rate (NL/min) | 0.3 | 0.3 | 0.3 | 0.3 | 0.3 | 0.3 | 0.3 | 0.2 | 0.3 | 0.3 | 0.1 | 0.15 | 0.3 | 0.3 | 0.3 | 0.6 |
| | | discharge rate (m/s) | 3 | 3 | 3 | 3 | 3 | 3 | 3 | 2 | — | 3 | 6 | 9 | 3 | 3 | 3 | 35 |
| | carrier gas (inside) | flow rate (NL/min) | 0.7 | 0.7 | 0.7 | 0.7 | 0.7 | 0.7 | 0.7 | 0.5 | — | 0.7 | 0.02 | 0.1 | 0.7 | 0.7 | 0.7 | 0.4 |
| | | discharge rate (m/s) | 60 | 60 | 60 | 60 | 60 | 60 | 60 | 43 | — | 60 | 2 | 9 | 60 | 60 | 60 | 35 |
| | discharge portion temp. of spraying nozzle (° C.) | | 75 | 75 | 75 | 75 | 75 | 75 | 75 | 75 | 75 | 130 | 75 | 75 | 75 | 75 | 220 | 75 |
| | reactant liquid flow rate (g/min) | | 0.11 | 0.11 | 0.11 | 0.11 | 0.11 | 0.11 | 0.11 | 0.11 | 0.003 | 0.11 | 0.11 | 0.11 | 0.11 | 0.11 | 0.11 | 0.11 |
| | remarks | | | | | | | | | reactant liquid A was supplied in liquid (0.11 g/min) | reactant liquid B was supplied in gaseous state (0.003 g/min) | | | | | reactant liquid was supplied in gaseous state | | |

In the above Table 1, the numerical values are expressed in terms of mass %.
PPG: Polypropylene glycol having a molecular weight as shown in the corresponding parentheses.
AOT: di-isooctyl sodium sulfosuccinate

TABLE 2

| | Carbon recovery percentage | Form of produced carbon fibers |
|---|---|---|
| Example 1 | 31% | fibrous carbon having fiber diameter of about 100 nm |
| Example 2 | 51% | fibrous carbon having fiber diameter of about 100 nm |
| Example 3 | 40% | fibrous carbon having fiber diameter of about 100 nm |
| Example 4 | 31% | fibrous carbon having fiber diameter of about 100 nm |
| Example 5 | 24% | fibrous carbon having fiber diameter of about 100 nm |
| Example 6 | 39% | fibrous carbon having fiber diameter of about 100 nm |
| Example 7 | 33% | fibrous carbon having fiber diameter of about 100 nm |
| Example 8 | 36% | fibrous carbon having fiber diameter of about 100 nm |
| Example 9 | 30% | fibrous carbon having fiber diameter of about 100 nm |
| Example 10 | 35% | fibrous carbon having fiber diameter of about 100 nm |
| Example 11 | 35% | fibrous carbon (partially, spherical product) |
| Comp. Ex. 1 | 22% | spherical product (partially, fibrous carbon) |
| Comp. Ex. 2 | 37% | spherical product (partially, fibrous carbon) |
| Comp. Ex. 3 | 27% | mixture of fibrous product and spherical product |
| Comp. Ex. 4 | 31% | mixture of fibrous product and spherical product |

INDUSTRIAL APPLICABILITY

As described hereinabove, according to the present invention, a specific additional component is supplied to a reaction system and the conditions are controlled in a specific manner, while the necessity of a pretreatment such as preliminary carriage of a catalyst can be removed, to thereby suppress the aggregation of the catalyst particles and larger particle formation from the catalyst particles. As a result, as compared with the supported process, a marked reduction in the number of the steps constituting the production process can be achieved by the present invention, and therefore the present invention is economically advantageous. In addition, according to the present invention, carbon fibers can be produced with a high yield by using an extremely small amount of the catalyst, and carbon fibers can be produced inexpensively.

The invention claimed is:

1. A process for continuously producing carbon fibers in a vapor phase by causing a carbon compound to contact a catalyst and/or a catalyst precursor compound in a heating zone of a reactor;

wherein the carbon compound, the catalyst precursor compound and an additional component are supplied to the heating zone, and these components are subjected to a reaction under a reaction condition in the heating zone such that at least a portion of the additional component is present as a solid or liquid in the heating zone, wherein the additional component is different from the carbon compound and the catalyst compound and the catalyst and/or the catalyst precursor compound is not immobilized on the additional component by a chemical interaction but each of the components is supplied without any chemical reaction to the heating zone of the reactor.

2. A process for producing vapor-phase carbon fibers according to claim 1, wherein the reaction condition is at least one kind selected from: the temperature of the heating zone, the residence time, the concentration of the additional component to be supplied, and the method of supplying raw materials for the reaction.

3. A process for producing vapor-phase carbon fibers according to claim 1 or 2, wherein the additional component is supplied to the heating zone in a liquid state, a solution state, or a mixture comprising the additional component dispersed in a liquid.

4. A process for producing vapor-phase carbon fibers according to claim 1 or 2, wherein the catalyst precursor compound and the additional component are dissolved or dispersed in the same liquid which may also function as a carbon source, and the resultant solution or dispersion is supplied to the heating zone.

5. A process for producing vapor-phase carbon fibers according to claim 1 or 2, wherein the catalyst precursor compound is supplied to the heating zone in a gaseous state; and the additional component is dissolved or dispersed in a liquid which may also function as a carbon source, and the resultant solution or dispersion is supplied to the heating zone.

6. A process for producing vapor-phase carbon fibers according to claim 3, wherein a liquid component including the additional component is supplied by using a spraying nozzle provided in a reaction tube.

7. A process for producing vapor-phase carbon fibers according to claim 6, wherein the temperature of the discharge portion of the spraying nozzle is 200° C. or lower.

8. A process for producing vapor-phase carbon fibers according to claim 6, wherein the discharge rate of the liquid component including the additional component, and the discharge rate of a gas component are 30 m/s or below at the discharge portion of the nozzle.

9. A process for producing vapor-phase carbon fibers according to claim 8, wherein the gas component comprises a carrier gas.

10. A process for producing vapor-phase carbon fibers according to claim 1 or 2, wherein the additional component is an organic compound or organic polymer.

11. A process for producing vapor-phase carbon fibers according to claim 1, wherein the additional component is at least one selected from the group consisting of the following additional components (1) to (3), Additional component (1): inorganic compounds having a temperature of 180° C. or higher as the lower one selected from the boiling point and decomposition temperature thereof;

Additional component (2): organic compounds having a temperature of 180° C. or higher as the lower one selected from the boiling point and decomposition temperature thereof; and Additional component (3): organic polymers having a molecular weight of 200 or higher.

12. A process for producing vapor-phase carbon fibers according to claim 11, wherein the additional component (1) is an inorganic compound containing at least one element selected from the group consisting of: Group II-XV elements in the 18-group type periodic table of elements.

13. A process for producing vapor-phase carbon fibers according to claim 11, wherein the additional component (1) is an inorganic compound containing at least one element selected from the group consisting of: Mg, Ca, Sr, Ba, Y, La, Ti, Zr, Cr, Mo, W, Fe, Co, Ni, Cu, Zn, B, Al, C, Si, and Bi.

14. A process for producing vapor-phase carbon fibers according to claim 11, wherein the additional component (1) is at least one selected from the group consisting of: powdery activated carbon, graphite, silica, alumina, magnesia, titania, zirconia, zeolite, calcium phosphate, aluminum phosphate, or carbon fibers having an aspect ratio of not smaller than 1 and not larger than 50, and an average fiber diameter of and not smaller than 10 nm and not larger than 300 nm.

15. A process for producing vapor-phase carbon fibers according to claim 11, wherein the additional component (2) is an organic compound containing at least one element selected from the group consisting of: oxygen, nitrogen, sulfur and phosphorus.

16. A process for producing vapor-phase carbon fibers according to claim 11, wherein the additional component (2) is at least one organic compound selected from the group consisting of: halogenated ethylenes, dienes, acetylene derivatives, styrene derivatives, vinyl ester derivatives, vinyl ether derivatives, vinyl ketone derivatives, acrylic acid derivatives, methacrylic acid derivatives, acrylic acid ester derivatives, methacrylic acid ester derivatives, acrylic amide derivatives, methacryl amide derivatives, acrylonitrile derivatives, methacrylonitrile derivatives, maleic acid derivatives, maleimide derivatives, vinyl amine derivatives, phenol derivatives, melamines, urea derivatives, amine derivatives, carboxylic acid derivatives, carboxylic acid ester derivatives, diol derivatives, polyol derivatives, isocyanate derivatives, and isothiocyanate derivatives.

17. A process for producing vapor-phase carbon fibers according to claim 11, wherein the additional component (3) is an organic polymer containing at least one element selected from the group consisting of: oxygen, nitrogen, sulfur and phosphorus.

18. A process for producing vapor-phase carbon fibers according to claim 11, wherein the additional component (3) is a polymer which has been obtained by the polymerization of at least one organic compound selected from the group consisting of: olefins, halogenated ethylenes, dienes, acetylene derivatives, styrene derivatives, vinyl ester derivatives, vinyl ether derivatives, vinyl ketone derivatives, acrylic acid derivatives, methacrylic acid derivatives, acrylic acid ester derivatives, methacrylic acid ester derivatives, acrylic amide derivatives, methacryl amide derivatives, acrylonitrile derivatives, methacrylonitrile derivatives, maleic acid derivatives, maleimide derivatives, vinyl amine derivatives, phenol derivatives, melamines/urea derivatives, amine derivatives, carboxylic acid derivatives, carboxylic acid ester derivatives, diol derivatives, polyol derivatives, isocyanate derivatives, and isothiocyanate derivatives.

19. A process for producing vapor-phase carbon fibers according to claim 1, wherein the catalyst precursor compound is a compound which can be converted into a gas in the heating zone.

20. A process for producing vapor-phase carbon fibers according to claim 1, wherein the catalyst precursor compound contains at least one element selected from the group consisting of: Group III, V, VI, VIII, IX and X elements in the 18-group type periodic table of elements.

21. A process for producing vapor-phase carbon fibers according to claim 20, wherein the mass ratio of the additional component and a metal atoms contained in the catalyst precursor compound (additional component/metal atoms in catalyst precursor compound) is 0.001-10000.

* * * * *